US009909262B1

(12) United States Patent
Garcia

(10) Patent No.: US 9,909,262 B1
(45) Date of Patent: Mar. 6, 2018

(54) RAIL-LIFTING HOOK

(71) Applicant: Raul Garcia, Lubbock, TX (US)

(72) Inventor: Raul Garcia, Lubbock, TX (US)

( * ) Notice: Subject to any disclaimer, the term of this patent is extended or adjusted under 35 U.S.C. 154(b) by 0 days.

(21) Appl. No.: 15/484,242

(22) Filed: Apr. 11, 2017

(51) Int. Cl.
*B66C 1/62* (2006.01)
*E01B 29/04* (2006.01)
*B66C 1/64* (2006.01)

(52) U.S. Cl.
CPC ..... *E01B 29/04* (2013.01); *B66C 1/62* (2013.01); *B66C 1/64* (2013.01)

(58) Field of Classification Search
CPC .... B66C 1/14; B66C 1/22; B66C 1/34; B66C 1/62; B66C 1/64; E01B 29/04; E01B 29/16; E01B 29/17; E01B 29/20; E01B 29/22
USPC ..... 294/82.1
See application file for complete search history.

(56) References Cited

U.S. PATENT DOCUMENTS 512,726 A 1/1894 Lillis
1,223,452 A * 4/1917 Vogel ..... E01B 29/20 254/43
1,843,889 A * 2/1932 Ter Voorde ..... E01B 29/20 104/2
1,971,785 A 8/1934 Arthur
2,693,386 A 11/1954 Renfroe
2,877,974 A 3/1959 Estes
3,930,585 A * 1/1976 Lynch ..... B65G 59/02 248/339
4,171,842 A * 10/1979 Tolle ..... B66C 1/34 294/82.1
4,193,627 A * 3/1980 Cranston ..... B66C 1/36 294/82.1
4,371,203 A 2/1983 Munro
7,134,701 B1 * 11/2006 Ronning ..... B66C 1/22 294/67.3
8,434,801 B2 5/2013 LeBlanc
D686,062 S 7/2013 Thompson
2004/0217610 A1 * 11/2004 Hollman ..... B66C 1/22 294/67.22
2008/0277549 A1 11/2008 Curtin

FOREIGN PATENT DOCUMENTS

WO 2005124042 A1 12/2005

* cited by examiner

*Primary Examiner* — Dean J Kramer
(74) *Attorney, Agent, or Firm* — Kyle A. Fletcher, Esq.

(57) ABSTRACT

The rail-lifting hook is a J shaped lifting hook that is specifically configured to replace chains and slings when lifting a railway track rail. The railway track rail is configured to receive the entire railway track rail within the interior surface of the hook structure of the J shaped lifting hook. The rail-lifting hook is formed as a single unit from high strength steel.

8 Claims, 4 Drawing Sheets

RAIL-LIFTING HOOK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including hoisting lifting and hauling, more specifically, a load engaging element of device for a crane, capstan, winch, or tackle.

SUMMARY OF INVENTION

The rail-lifting hook is a J shaped lifting hook that is specifically configured to replace chains and slings when lifting a railway track rail. The railway track rail is configured to receive the entire railway track rail within the interior surface of the hook structure of the J shaped lifting hook. The rail-lifting hook is formed as a single unit from high strength steel.

These together with additional objects, features and advantages of the rail-lifting hook will be readily apparent to those of ordinary skill in the art upon reading the following detailed description of the presently preferred, but nonetheless illustrative, embodiments when taken in conjunction with the accompanying drawings.

In this respect, before explaining the current embodiments of the rail-lifting hook in detail, it is to be understood that the rail-lifting hook is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rail-lifting hook.

It is therefore important that the claims be regarded as including such equivalent construction insofar as they do not depart from the spirit and scope of the rail-lifting hook. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
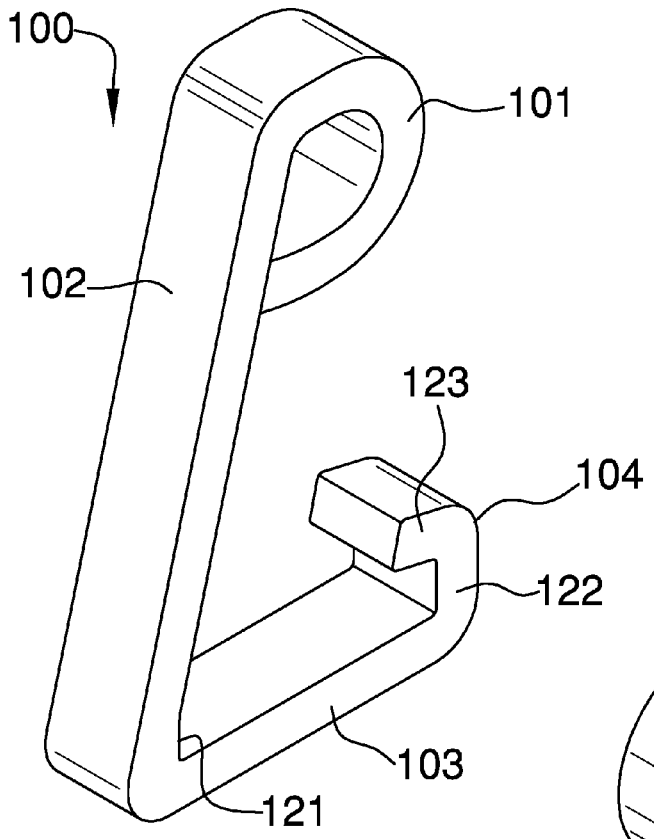
FIG. 1 is a perspective view of an embodiment of the disclosure.
Figure 2:
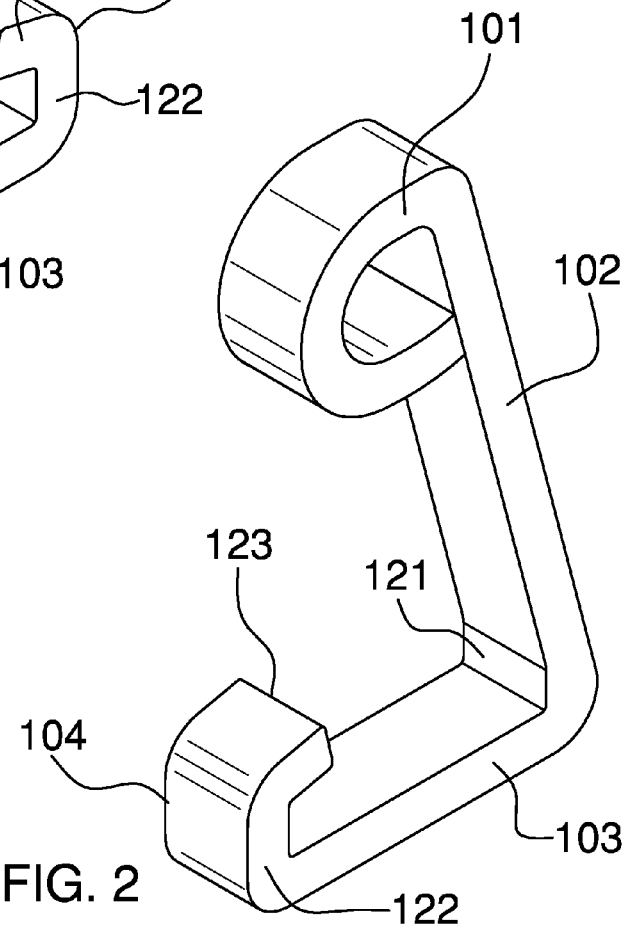
FIG. 2 is a reverse perspective view of an embodiment of the disclosure.
Figure 3:
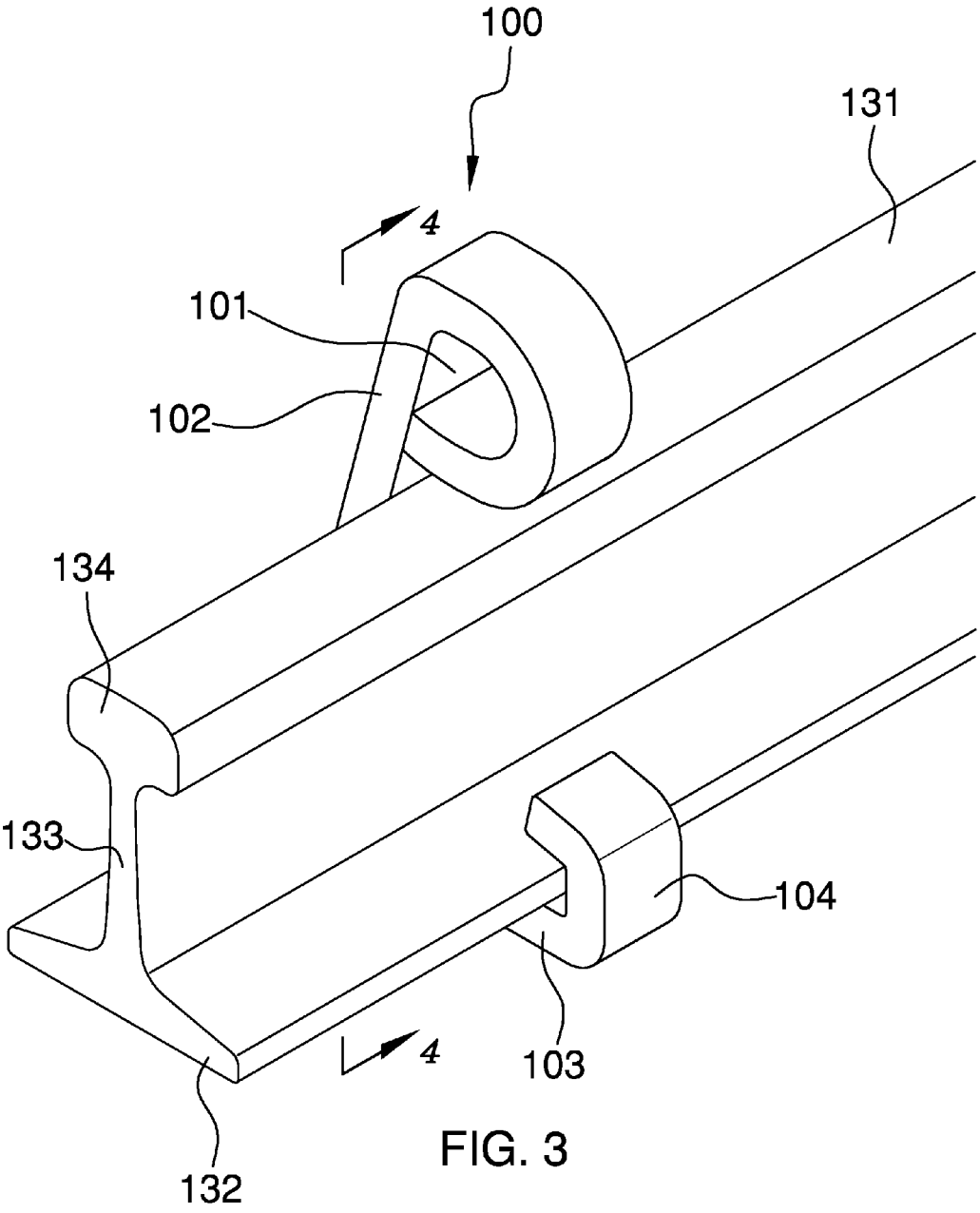
FIG. 3 is an in use view of an embodiment of the disclosure.
Figure 4:
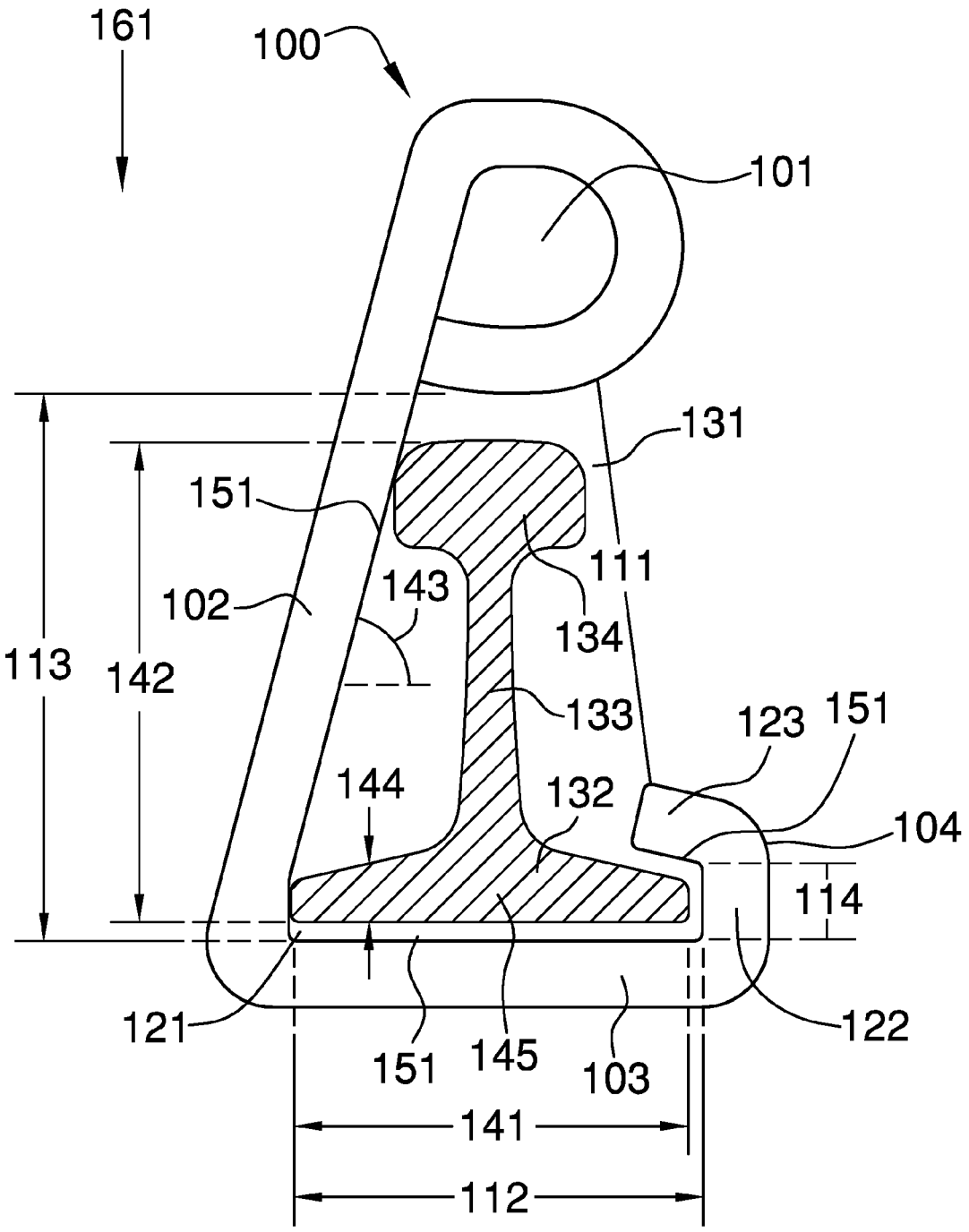
FIG. 4 is a side view of an embodiment of the disclosure.
Figure 5:
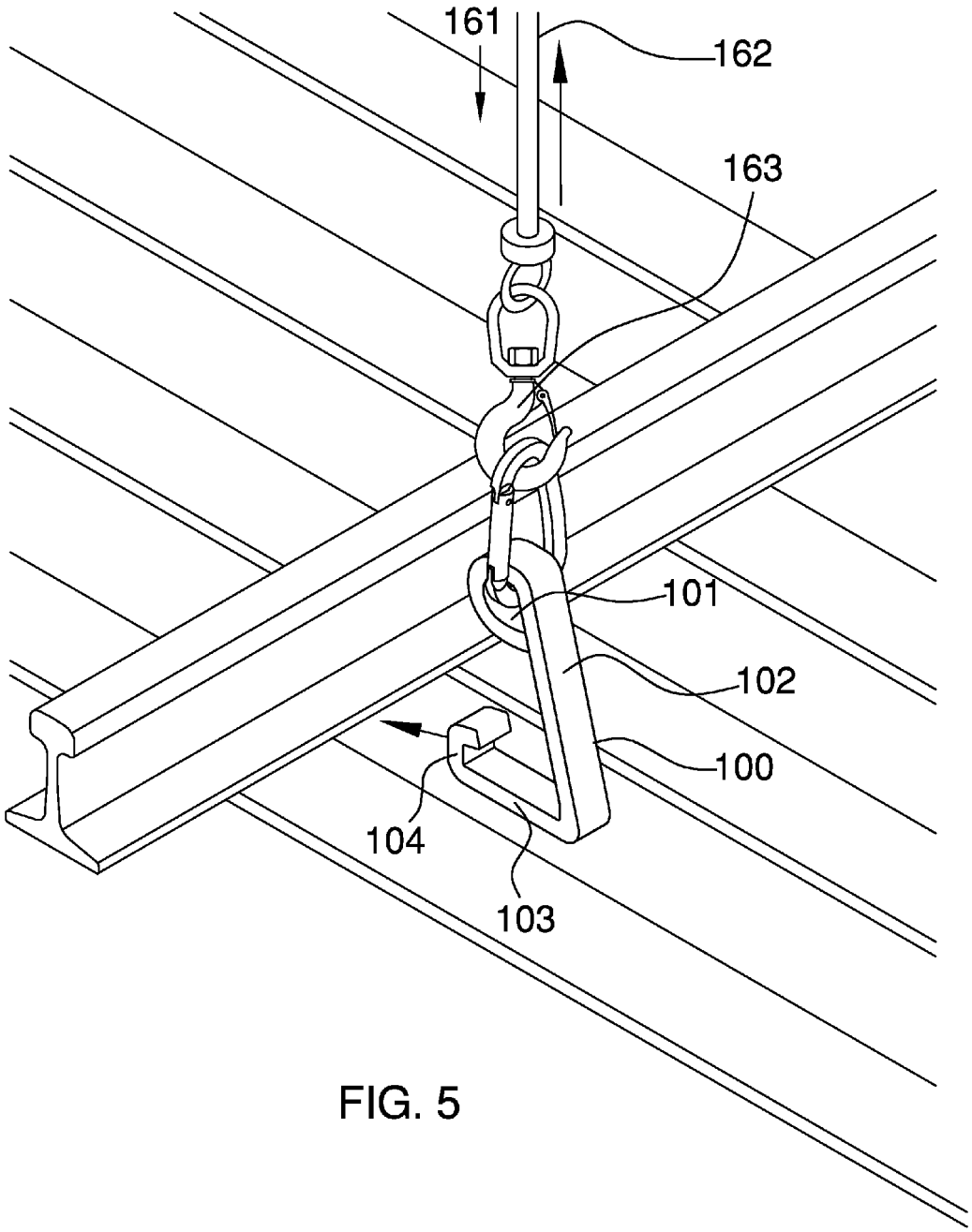
FIG. 5 is an in use view of an embodiment of the disclosure.

Detailed reference will now be made to one or more potential embodiments of the disclosure, which are illustrated in FIGS. 1 through 5.

The rail-lifting hook 100 (hereinafter invention) is a J shaped lifting hook that is specifically configured to replace chains and slings when lifting a railway track rail 131. The invention 100 is configured to receive the entire railway track rail 131 within the interior surfaces 151 of the hook structure of the J shaped lifting hook. The invention 100 is formed as a single unit from high strength steel.

The railway track rail 131 is a commercially available track that forms the guiding structure of the train in a railroad track. The foot 132 is the portion of the railway track rail 131 that is placed against the supporting surface of the railroad track. The web 133 is a stanchion structure that attaches the head 134 to the foot 132. The web 133 projects perpendicularly away from the supporting surface. The head 134 is a structure that is formed at the end of the web 133 that is distal from the foot 132. The head 134 is used to guide each wheel of a vehicle that is using the railroad track. The purpose of the head 134 is to guide each wheel of the vehicle such that each wheel of the vehicle follows the path followed by each preceding wheel of the vehicle. The railway track rail 131 is further defined with a foot 132, a web 133, and a head 134. The foot 132 is further defined with a foot span 141. The railway track rail 131 is further defined with a rail height 142 and a cant 143.

In the first potential embodiment of the disclosure, the invention 100 is formed as an integrated single unit. The single unit of the invention 100 is functionally segmented into the eye 101, the shank 102, the bend 103, and the anchor 104. For purposes of clarity and simplicity, this disclosure will discuss the eye 101, the shank 102, the bend 103, and the anchor 104 as separate units even though the eye 101, the shank 102, the bend 103, and the anchor 104 form a single physical structure. Those skilled in the mechanical arts will recognize that this simplifying assumption will not in any way limit the operation of the invention 100 and should not be interpreted to in anyway way limit the scope of the claims.

The invention 100 is a hook like structure within which the railway track rail 131 is placed such that the lifting of the invention 100 will raise the railway track rail 131. The invention 100 is lifted via a lifting device 162. The lifting device 162 refers to a mechanical device that is designated to lift the railway track rail 131. It is anticipated that the lifting device 162 is selected from the group consisting of a crane or a hoist. The inner dimensions of the invention 100 are greater than the outer dimensions of the railway track rail 131 such that the railway track rail 131 will fit within the interior surfaces 151 of the invention 100. The interior surface 151 refers to the surfaces of the invention 100 that are used to contain the railway track rail 131. The invention 100 is further defined with a gap 111, a shank clearance 112, a bend clearance 113, and an anchor clearance 114.

The invention 100 comprises an eye 101, a shank 102, a bend 103, and an anchor 104. The invention 100 further comprises a wedge 121. The wedge 121 refers to the interior surface 151 corner formed by the joining of the shank 102 and the bend 103. When the invention 100 is in use the force of gravity 161 presses the foot 132 against the wedge 121 to hold the railway track rail 131 in position within the interior surface 151 of the invention 100. The wedge 121 is a corner structure of the interior surface 151 of the invention 100 that is formed at the junction of the shank 102 and the bend 103. The form factor of the wedge 121 is designed to match the form factor of the foot 132 of the railway track rail 131 such that the railway track rail 131 can be readily wedged against the wedge 121 when the invention 100 is in use. The force of gravity 161 refers to the action and direction of the earth's gravitational attraction on both the invention 100 and the railway track rail 131.

The eye 101 is a closed loop that is formed within the invention 100. The eye 101 attaches the invention 100 to the lifting device 162. A fastening device 163 that attaches the lifting device 162 to the eye 101 is assumed to be provided via the lifting device 162. It is preferred that the fastening device 163 be a locking device such that the eye 101 will not inadvertently decouple from the lifting device 162.

The shank 102 is a rectangular block structure that attaches the eye 101 to the bend 103. The orientation of the interior surface 151 of the shank 102 matches the cant 143 of the railway track rail 131. The matching of the cant 143 by the shank 102 allows the railway track rail 131 to be wedged against the shank 102 during use of the invention 100.

The bend 103 is a rectangular block structure. The bend 103 is the structure of the invention 100 that supports the railway track rail 131 against the force of gravity 161. The interior surface 151 of the bend 103: 1) is perpendicular to the force of gravity 161; and, 2) forms the supporting surface for the railway track rail 131.

The anchor 104 holds the railway track rail 131 in position within the invention 100 such that the railway track rail 131 the interior surface 151 of the bend 103. The anchor 104 is positioned at the end of the bend 103 that is distal from the shank 102. The anchor 104 comprises a reverse 122 and a point 123.

The reverse 122 is a rectangular block structure that projects away from the bend 103 in the direction of the eye 101. The reverse 122 is located at the end of the bend 103 that is distal from the shank 102. The point 123 is a rectangular block structure that projects away from the reverse 122 in the direction of the shank 102. The point 123 is located at the end of the reverse 122 that is distal from the bend 103.

The gap 111 is specifically defined as the minimum span of distance between the point 123 and the bend 103. In order to install and remove the railway track rail 131 within the invention 100, the railway track rail 131 must pass through the gap 111. The shank clearance 112 is the minimum span of the distance between the shank 102 and the reverse 122 as measured parallel to the interior surface 151 of the bend 103. The bend clearance 113 is the minimum span of the distance between the eye 101 and the bend 103 as measured from the perpendicular to the bend 103. The anchor clearance 114 is the minimum span of the distance between the point 123 and the bend 103 as measured parallel to the bend clearance 113.

The foot span 141 is the maximum span of the distance of the foot 132 as measured by a straight line. The rail height 142 is the maximum span of the distance of the railway track rail 131 as measured by a straight line. The cant 143 refers to the measure of the angle between: 1) a line that tangent to both the foot 132 and the head 134; and, 2) a line that is parallel to the interior surface 151 of the bend 103. The foot depth 144 is a description of the vertical height of the foot 132. The foot depth 144 is generally not constant across the cross-section 145. The cross-section 145 refers to the cross-sectional area of the railway track rail 131.

The rail height 142 is less than the bend clearance 113 such that the railway track rail 131 will fit within the bend clearance 113. The foot depth 144 is less than the anchor clearance 114 such that the foot 132 will fit within the anchor clearance 114. The foot span 141 is less than the shank clearance 112 such that the foot 132 will fit within the shank clearance 112.

The following definitions were used in this disclosure:

Cant: As used in this disclosure, a cant is an angular deviation from one or more reference planes such as a vertical plane or a horizontal plane.

Cross-section: As used in this disclosure, a cross-section is a surface or shape that would be exposed by making a straight cut through an object.

Exterior: As used in this disclosure, the exterior is use as a relational term that implies that an object is not contained within the boundary of a structure or a space.

Fastener: As used in this disclosure, a fastener is a device that is used to join or affix two objects. Fasteners generally comprise a first element, which is attached to the first object and a second element which is attached to the second object such that the first element and the second element join to affix the first object and the second object.

Force Of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

High Strength Steel: As used in this disclosure, a high strength steel is a commercially available steel (commonly a steel alloy) that is considered suitable for use in applications such as the construction of buildings, the manufacturing of cranes, military armor and other applications where the steel is expected to bear large loads. Commercially available steels that are marketed as A514 or A517 steels would be considered suitable for use as a high strength steels within this definition.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is use as a relational term that implies that an object is contained within the boundary of a structure or a space.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Rectangular Block: As used in this disclosure, a rectangular block refers to a three dimensional structure comprising six rectangular surfaces formed at right angles. Within this disclosure, a rectangular block may further comprises rounded edges and corners.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Supporting Surface: As used in this disclosure, a supporting surface is a horizontal surface upon which an object is placed.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A load engaging element comprising:

wherein the load engaging element is a J shaped lifting hook;

wherein the load engaging element that is configured for lifting a railway track rail;

wherein the railway track rail is further defined with a foot, a web, and a head;

wherein the load engaging element receives the railway track rail within the interior surfaces of the J shaped lifting hook;

wherein the foot is further defined with a foot span;

wherein the railway track rail is further defined with a rail height and a cant;

wherein the load engaging element is lifted by a lifting device;

wherein the load engaging element comprises an eye, a shank, a bend, and an anchor;

wherein the shank attaches the eye to the bend;

wherein the bend attaches the shank to the anchor wherein the load engaging element is further defined with a gap, a shank clearance, a bend clearance, and an anchor clearance;

wherein the load engaging element further comprises a wedge;

wherein the wedge is the interior surface corner formed by the joining of the shank and the bend;

wherein the wedge is designed to match the foot of the railway track rail;

wherein the eye is a closed loop that is formed within the load engaging element;

wherein the eye attaches the load engaging element to the lifting device;

wherein the shank is a rectangular block structure;

wherein the orientation of the interior surface of the shank matches the cant of the railway track rail;

wherein the bend is a rectangular block structure;

wherein the bend is the structure of the load engaging element that supports the railway track rail;

wherein the interior surface of the bend is perpendicular to the force of gravity;

wherein the interior surface of the bend forms the supporting surface for the railway track rail;

wherein the anchor holds the railway track rail in position within the load engaging element such that the railway track rail will not escape the load engaging element by shifting laterally along the interior surface of the bend;

wherein the anchor is positioned at the end of the bend that is distal from the shank;

wherein the anchor comprises a reverse and a point;

wherein the reverse attaches the point to the bend;

wherein the reverse is a rectangular block structure;

wherein the reverse projects away from the bend in the direction of the eye;

wherein the point is a rectangular block structure that projects away from the reverse in the direction of the shank;

wherein the point is located at the end of the reverse that is distal from the bend.

2. The load engaging element according to claim 1 wherein the gap is the minimum span of distance between the point and the eye;

wherein in order to install the railway track rail within the load engaging element, the railway track rail must pass through the gap.

3. The load engaging element according to claim 2 wherein the shank clearance is the minimum span of the distance between the shank and the reverse as measured parallel to the interior surface of the bend;

wherein the foot span is the maximum span of the distance of the foot as measured by a straight line;

wherein the foot span is less than the shank clearance such that the foot will fit within the shank clearance.

4. The load engaging element according to claim 3 wherein the bend clearance is the minimum span of the distance between the eye and the bend as measured from the perpendicular to the bend;

wherein the rail height is the maximum span of the distance of the railway track rail as measured by a straight line;

wherein the rail height is less than the bend clearance such that the railway track rail will fit within the bend clearance.

5. The load engaging element according to claim 4 wherein the anchor clearance is the minimum span of the distance between the point and the bend as measured parallel to the bend clearance;

wherein the foot depth measures the vertical height of the foot;

wherein the foot depth is less than the anchor clearance such that the foot will fit within the anchor clearance.

6. The load engaging element according to claim 5 wherein the load engaging element is formed as a single unit.

7. The load engaging element according to claim 6 wherein the load engaging element is formed from high strength steel.

8. The load engaging element according to claim 7 wherein when the load engaging element is in use the force of gravity presses the foot against the wedge to hold the railway track rail in position within the interior surface of the load engaging element.

* * * * *